US005859431A

United States Patent [19]

Cotrell et al.

[11] Patent Number: 5,859,431

[45] Date of Patent: Jan. 12, 1999

[54] SAMPLE HOLDER FOR MASS SPECTROMETER

[75] Inventors: John Stanley Cotrell, London, United Kingdom; Kuldip Kaur Mock, Sunnyvale, Calif.

[73] Assignee: Finnigan Mat Limited, Hemel Hempstead, United Kingdom

[21] Appl. No.: 167,994

[22] PCT Filed: Jun. 19, 1992

[86] PCT No.: PCT/GB92/01108

§ 371 Date: Dec. 21, 1993

§ 102(e) Date: Dec. 21, 1993

[87] PCT Pub. No.: WO93/00700

PCT Pub. Date: Jan. 7, 1993

[30] Foreign Application Priority Data

Jun. 21, 1991 [GB] United Kingdom ..... 9113557

[51] Int. Cl.[6] ..... H01J 49/04; H01J 49/16

[52] U.S. Cl. ..... 250/288; 250/281; 250/282

[58] Field of Search ..... 250/288, 288 A, 250/281

[56] References Cited

U.S. PATENT DOCUMENTS

| | | | |
|---|---|---|---|
| 4,620,103 | 10/1986 | Kambara et al. | 250/288 |
| 4,705,705 | 11/1987 | Bross | 428/13 |
| 5,083,020 | 1/1992 | Takahashi | 250/288 |

FOREIGN PATENT DOCUMENTS

| | | |
|---|---|---|
| A 0 199 343 | 10/1986 | European Pat. Off. . |
| 0 326 349 A2 | 2/1989 | European Pat. Off. . |
| 0 326 572 A2 | 6/1990 | European Pat. Off. . |
| 32 21 681 A1 | 12/1983 | Germany . |
| 1405567 | 10/1975 | United Kingdom . |

*Primary Examiner*—Jack I. Berman
*Attorney, Agent, or Firm*—Flehr, Hohbach, Test, Albritton & Herbert

[57] ABSTRACT

A sample holder (1) for use in mass spectrometry comprises a plate having a flat (5), which flat includes a first region having a smooth surface surrounding a second region having a rough surface (7). The second region defines the location for loading a sample.

8 Claims, 1 Drawing Sheet

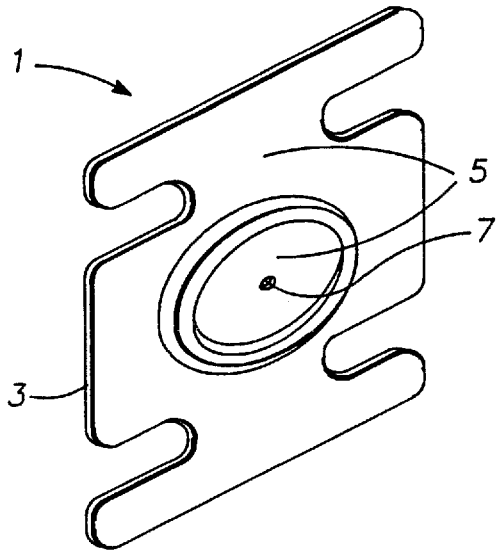
FIG.—1
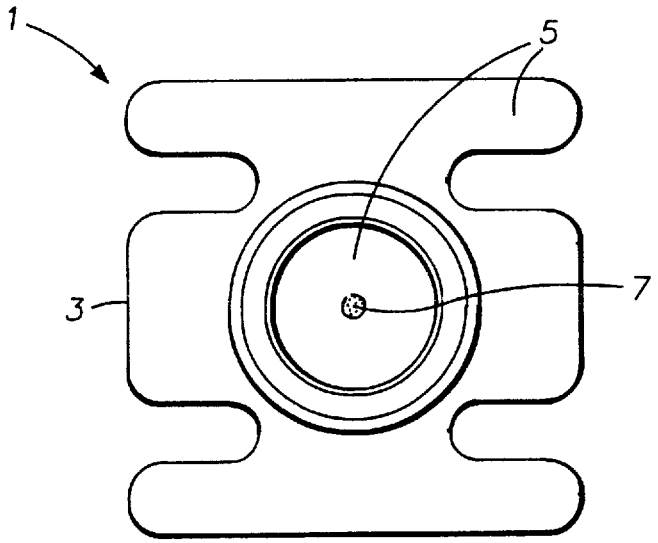
FIG.—2
FIG.—3
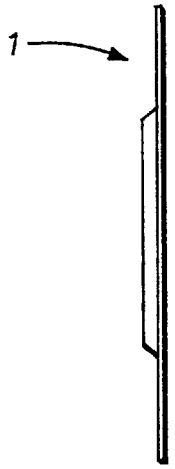

SAMPLE HOLDER FOR MASS SPECTROMETER

This invention relates to a sample holder to be used in the analysis of a sample by Laser Desorption mass spectrometry (LDMS). In LDMS, ions are sputtered from the surface of a condensed phase sample by photon bombardment and subjected to mass analysis.

There are many embodiments of Laser Desorption mass spectrometers which differ in detail. An important feature of certain embodiments is the use of a matrix material in which the analyte of interest is dispersed. In the procedure described by M. Karas et. al. (Int. J. Mass Spectrom. Ion Processes 78 53 (1987), a large molar excess of a matrix which has a strong absorption at the wavelength of the incident radiation is mixed with the sample to be analysed. For example, they dissolved a sample of a bovine insulin in an aqueous solution containing a thousand-fold molar excess of Nicotinic Acid (59-67-6). A drop of the solution was placed on a metal plate, evaporated to dryness, introduced into the mass spectrometer, and irradiated with 266 nm ultraviolet photons from a frequency quadrupled pulsed Neodymium YAG laser. Desorbed ions were accelerated to an energy of 3 keV and analysed by measuring their time of flight to an electron multiplier detector.

The sensitivity of analysis by a Laser Desorption mass spectrometer depends critically on the detailed sample loading procedure. Ions can only be produced from those regions of the sample deposit which are irradiated by the laser beam. Sample which is not irradiated is wasted. The laser beam is generally focused to a small spot, typically 0.1 mm diameter. In principle, such a laser beam can be rastered over a much larger area. However, it is difficult to design extraction optics to accept ions from a very large area and focus them onto the detector without introducing a time spread which would degrade the mass resolution of the instrument. In addition, the mechanism to achieve controllable rastering over a large area adds cost and complexity to the instrument. A more desirable approach is to restrict the size of the sample deposit to a practical minimum. This raises the difficulty of identifying the precise spot at which the sample should be loaded on a relatively large area sample holder. It is also necessary to constrain the droplet to this spot while it dries. An object of the present invention is to provide a means of constraining the droplet to a predefined area while the solvent evaporates.

Identifying the spot at which the sample is to be loaded is not a trivial matter. The printing of marks using commercially available inks would limit the range of solvent systems which could be used for loading samples. Indented or engraved lines tend to attract the sample away from the desired spot by capillary attraction. For mass analysis by Time-of-Flight, it is important that the area from which ions originate is essentially flat, otherwise the variation in path length will cause a reduction in mass resolution. For this reason, a dished indentation to locate and contain the sample droplet is not feasible. Another object of the present invention is to provide a sample holder in which the optimum location for the sample deposit is clearly identified.

A further critical aspect of the sample loading procedure concerns the uniform drying of the droplet of sample and matrix solution. For reproducible results, it is necessary to achieve a reasonably homogeneous crystalline deposit on the sample target. If, for example, the sample and matrix have a tendency to separate on crystallisation, a slowly drying droplet may deposit the majority of the sample as a peripheral ring which is outside the area to be irradiated.

Thus, a further object of the present invention is to provide a sample holder which enables a reasonably homogeneous sample deposit to be achieved.

The present invention provides a sample holder for use in mass spectrometry comprising a plate having a flat, said flat including a first region having a smooth surface surrounding a second region having a rough surface, said second region defining the location for loading a sample.

A smooth surface refers to a surface that is generally lustrous and scratch free. A rough surface refers to a surface that is rough on a generally microscopic scale.

In contrast to the smooth region, the rough region provides an area of good wettability so that a droplet is constrained to this region. The visual contrast between the smooth and rough regions also enables the location for the sample deposit to be clearly identified. Furthermore, the rough region provides a multitude of nucleation sites scattered around the area to be irradiated, encouraging rapid crystallisation of the sample so that a reasonably homogeneous crystalline deposit is achieved.

In general, the surface of the second region should be sufficiently rough relative to the surface of the first region such that the second region is more wettable than the first. For example, sufficient contrast is achieved if the first region has an average roughness of less than about 1 microinch or 0.025 micron and the second region has an average roughness of greater than about 8 microinch or 0.2 micron.

The first region is preferably polished to a high quality finish so that wetting in this region is extremely difficult. This serves to encourage the sample away from this region and onto the rough region to assist in loading. Furthermore, the boundary between the smooth and rough regions will be more sharply defined.

In a preferred embodiment the second region, having a rough surface, is located at the centre of the sample holder and has the form of a circular spot.

An example of an embodiment of the present invention will now be described with reference to the drawings, in which:

FIG. 1 is a perspective view of a preferred embodiment of the present invention;

FIG. 2 is a plan view of the embodiment shown in FIG. 1, and

FIG. 3 is a side view of the embodiment shown in FIGS. 1 and 2.

The sample holder comprises a plate 1, preferably made from stainless steel, although other suitable materials may be used, and is large enough to be handled without the use of special tools. The periphery 3 of the holder 1 is shaped so as to facilitate location of the target within the mass spectrometer. A first region 5 of the sample holder surrounds a second region 7 being a circular area of diameter 2 mm in the centre of the front face.

The surface of region 5 has an average roughness of less than 1 microinch or 0.025 micron which can be produced, for example, by polishing and buffing with progressively fine abrasives or by electrolytic methods. The surface of the central spot 7 has an average roughness of the order of 16 microinch or 0.4 micron and is generally roughened by abrasion. The preferred method of abrasion is dry blasting with 180/220 mesh aluminium oxide expelled from a nozzle by compressed air at a rate of 14 cubic feet per minute and applied through an appropriate stencil. There are clearly many other methods of creating a well defined region of appropriate roughness and this invention is not intended to be restricted to any particular abrasion process.

The contrast between the roughened spot 7 and the surrounding polished surface 5 is sufficient to give a clear visual indication of where to load the sample. The roughened surface also tends to retain the droplet through being more wettable than the polished surface. Finally, the microscopically roughened surface provides a multitude of nucleation sites which ensure uniform crystallisation.

We claim:

1. A sample holder for use in mass spectrometry, comprising a plate having a flat, said flat including a first region having a smooth surface surrounding a second region having a rough surface, said second region defining the location for loading a sample.

2. A sample holder for use in mass spectrometry, including a plate having a flat, said flat including a first region surrounding a second region, wherein the second region is more wettable than the first region by virtue of surface roughness and defines the location for loading a sample.

3. A sample holder as claimed in claim 1 or 2, wherein said first region has a surface roughness of less than about 0.025 micron.

4. A sample holder as claimed in claim 1 or 2, wherein said second region has an average roughness of the order of 0.4 micron.

5. A sample holder as claimed in claim 1 or 2, wherein said second region is roughened by dry blasting.

6. A sample holder as claimed in claim 1 or 2, wherein said second region is positioned at the centre of the sample holder.

7. A sample holder as claimed in claim 1 or 2, wherein said second region is a circular spot.

8. A method of loading a sample for Laser Desorption mass spectrometer analysis onto a sample holder including the step of roughening the surface of a discrete region of the holder said region defining the location of loading the sample.

* * * * *